US005141348A

United States Patent [19]

'tartt

[11] Patent Number: 5,141,348

[45] Date of Patent: Aug. 25, 1992

[54] PASTE WAX APPLICATOR

[76] Inventor: Lester M. 'tartt, 308 Linden Ave., Easton, Md. 21601

[21] Appl. No.: 713,851

[22] Filed: Jun. 12, 1991

[51] Int. Cl.[5] ..... B43K 5/06

[52] U.S. Cl. ..... 401/179; 401/181; 401/140; 401/207

[58] Field of Search ..... 401/205, 206, 207, 140, 401/179, 180, 181, 171, 282

[56] References Cited

U.S. PATENT DOCUMENTS

| | | | |
|---|---|---|---|
| 1,795,673 | 3/1931 | Porchinger | 401/205 |
| 2,137,944 | 11/1938 | MacLeod | 401/140 |
| 2,211,275 | 8/1940 | Lachapelle | 401/140 |
| 2,438,843 | 3/1948 | Correa | 401/179 X |
| 3,120,676 | 2/1964 | Ballantyne | 401/282 X |
| 3,286,297 | 11/1966 | MacFarland | 401/179 |
| 4,262,822 | 4/1981 | Corte | 401/140 X |
| 4,944,623 | 7/1990 | McNeil | 401/207 X |

FOREIGN PATENT DOCUMENTS

| | | | |
|---|---|---|---|
| 118201 | 12/1926 | Switzerland | 401/180 |
| 135183 | 11/1929 | Switzerland | 401/140 |

*Primary Examiner*—Danton D. DeMille

*Attorney, Agent, or Firm*—Walter F. Wessendorf, Jr.

[57] ABSTRACT

A paste wax applicator has a handle carried proximally on an elongated housing, allowing a human operator to remain in a non-fatiguing upright position by having one of his hands hold the handle and the other cradle the elongated housing, while applying to a floor surface paste wax dispensed from a cartridge tube. A plunger and the cartridge tube are housed by the elongated housing. The human operator actuates a cartridge-gun mechanism operatively connected via the plunger to the cartridge tube to incrementally drive the plunger, thereby causing paste wax to be dispensed from the cartridge tube for application upon the floor surface of the floor to be waxed.

6 Claims, 3 Drawing Sheets

PASTE WAX APPLICATOR

BACKGROUND OF THE INVENTION

1. This invention relates to a paste wax applicator to apply paste wax to a floor surface to be waxed.

2. Background

In the past, the only way for a human operator to apply paste wax to a floor surface was for the human operator to do so on his or her hands and knees. The problem in the art to which this invention apertains is the need for a paste wax applicator which allows the human operator not only to apply paste wax to a floor surface, while standing in an upright position, but also, while in such upright position, to maintain continuous discrete control over the amount of paste wax being dispensed and applied upon the floor surface.

SUMMARY OF THE INVENTION

Accordingly, the object of this invention is to contribute to the solution of the discussed problem of the art by providing a paste wax applicator that allows the human operator to remain standing in a comfortable upright position while dispensing and applying paste wax upon the floor surface to be waxed and, at the same time to maintain continuous discrete control over the amount of paste wax being dispensed and applied upon the floor

BRIEF DESCRIPTION OF THE DRAWINGS

This object and other objects of the invention should be discerned and appreciated from the detailed description of the preferred embodiment, taken in conjunction with the drawing figures, wherein like reference numeral refer to similar elements throughout the several drawing figures, in which.

DETAILED DESCRIPTION OF THE PREFERRED EMBODIMENT

Figure 1:
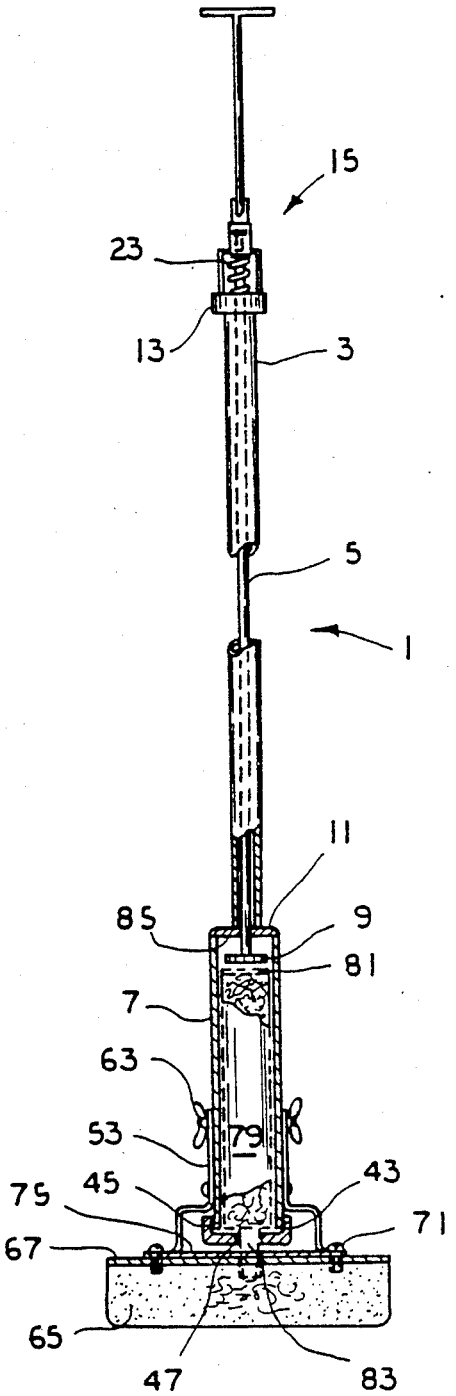
FIG. 1 is an elevational view, partly in section, of the invention.
Figure 6:
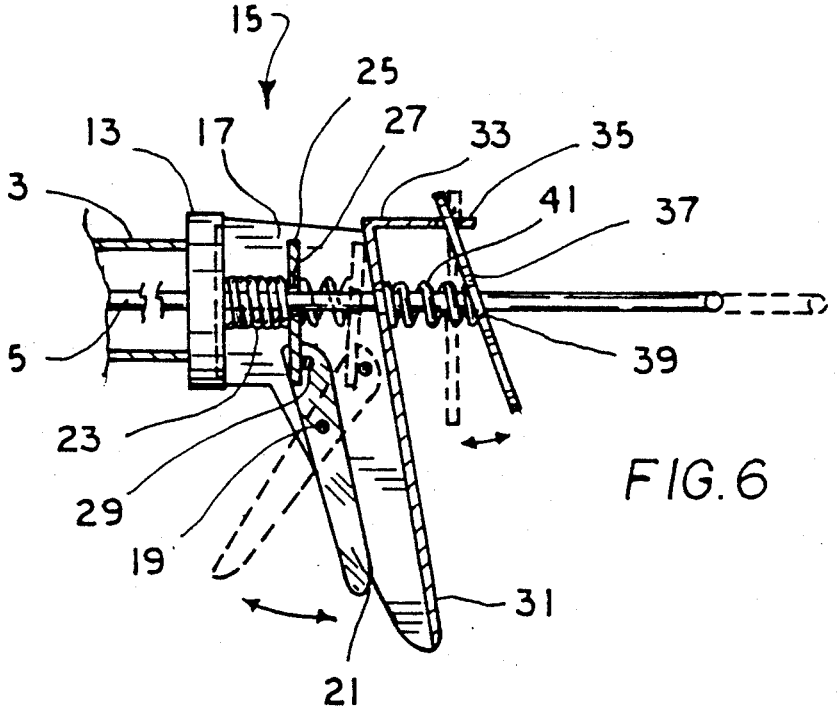
FIG. 6 is a side view of the proximal portion of the invention, partly in section, showing a conventional cartridge gun mechanism.

In FIG. 1 of the drawings, reference numeral 1 generally refers to the invention showing an elongated cylindrical housing 3 receiving a plunger 5, and a cylindrical cartridge-tube housing 7 receiving therein a piston 9 secured to the end of the plunger 5. Intermediate with and fixed to the distal end of the cylindrical housing 3 and the proximal end of the cartridge-tube housing 7 is an intermediate cap 11. Fixed to the proximal end of the housing 3 is an end cap 13. The caps 11 and 13 have aligned center holes which freely receive and centrally align plunger 5. A conventional cartridge-gun mechanism, generally referred to by reference numeral 15, is mounted on the proximal end portion of a handle 17, fixed to and extending from end cap 13. A pivot pin 19, fixedly carried by handle 17, pivotally mounts a trigger 21. Carried on the plunger 5 is a compression spring 23 and a drive pawl 25 via its discrete hole 27. A drive pin 29, fixedly carried by the trigger 21, engages the drive pawl 25. Upon the plunger 5 being released for movement, as will be subsequently described, squeezing the trigger 21 causes the drive pin 29 to move the drive pawl forward with its hole 27 lockingly engaging plunger 5 and thereby incrementally advancing plunger 5. Upon release of the trigger 21, the restoring force of the compression spring 23 returns the trigger 21 backward to its inoperative position, as shown by the dashed lines in FIG. 6, with such backward movement of the trigger 21 being stopped by its abutting engagement with an integral abutment plate 31 of the handle 17, which functions as a limit stop. A small leg 33, normal to and projecting from the abutment plate 31, has an opening 35 which receives and pivotally mounts the upper end of a locking pawl 37, shown in its locking position by the solid lines in FIG. 6. Locking pawl 37 is carried on the plunger 5 via its discrete hole 39. Carried on plunger 5 is a second compression spring 41 that is interposed between the abutment plate 31 and the locking pawl 37 To release the plunger 5 for movement in order to incrementally drive the plunger 5 forward, the human operator manipulatively grasps the handle 17 in an appropriately manner to dispose the locking pawl 37 in its unlocked position, shown by the dashed lines in FIG. 6, and squeezes the trigger 21; and with further forward incremental movements of the plunger 5 being effected by simply releasing and re-squeezing actuations of the trigger 21. An interiorally threaded end cap 43 is appropriately engaged with the threaded distal end 45 of the housing 7. End cap 43 has a central opening 47. Screws 49, freely received through holes 51 in the side arms 53 and engaged with tapped holes 55 formed in the wall of the housing 7, pivotally mount the side arms 53. Threaded studs 57, engaged with tapped holes 59 formed in the wall of housing 7, define limit stop pins which, upon their engagements with the slot bearing surfaces 61 of the side arms 53, prevent further clockwise movement of the side arms 53, as viewed in FIG. 2. Wing nuts 63, engaged with the threaded studs 57 and tightened against the side arms 53, lockingly retain the side arms in the position shown in FIG. 2. The structure heretofore described is made of metal or other suitable material. A fabricated spreader 65 is provided to spread paste wax forced into it by the paste wax applicator 1. Fixed to the top portion of the spreader 65, such as by adhesive, is a bracket plate 67, made of metal. A nozzle bearing sleeve 69, integral with and depending at an angle from the bracket plate 67 and projecting interiorly within the fabricated spreader 65. Screws 71, disposed through holes 73 in the integral mounting plate 75 for the side arms 53, engage tapped holes 77 in the bracket plate 67 to fixedly secure the side arms 53 to the bracket plate 67. A cartridge tube 79, filled with paste wax, is sealed with a circular plug 81 at its proximal end and has a nozzle 83 at its distal end that communicates with the interior of the cartridge tube 79. Preparatory to inserting a cartridge tube 79 within the housing 7, the locking pawl 37 is manipulatively disposed in its unlocked position and the plunger 5 is retracted via its handle so that the piston 9 abuts the distal portion 85 of the intermediate cap 11. The wing nuts 63 are appropriately loosened and the spreader 65 is pivoted to its position, shown in solid lines in FIG. 3. End cap 43 is removed and a cartridge tube 79 is inserted within the housing 7. The nozzle 83 is appropriately disposed through the central opening 47 of the end cap 43 along with appropriate repositioning of the spreader 65 to allow the distal end of the nozzle 83 to be received within the nozzle bearing sleeve 69, followed by engagement of the threaded end cap 43 with the threaded distal end 45 of the housing 7.

Figure 2:
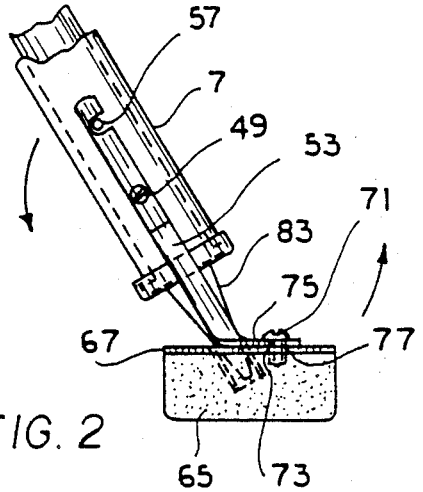
FIG. 2 is a side elevational view of the distal portion of the invention.
Figure 3:
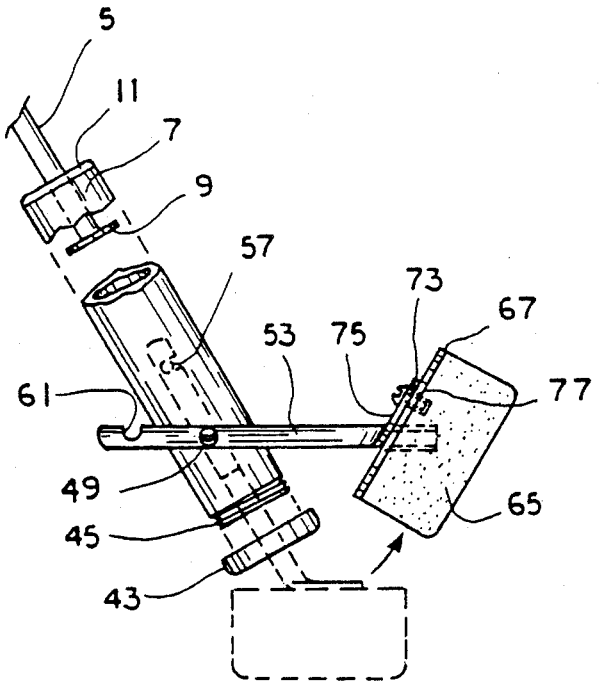
FIG. 3 is a side elevational view of the invention.
Figure 4:
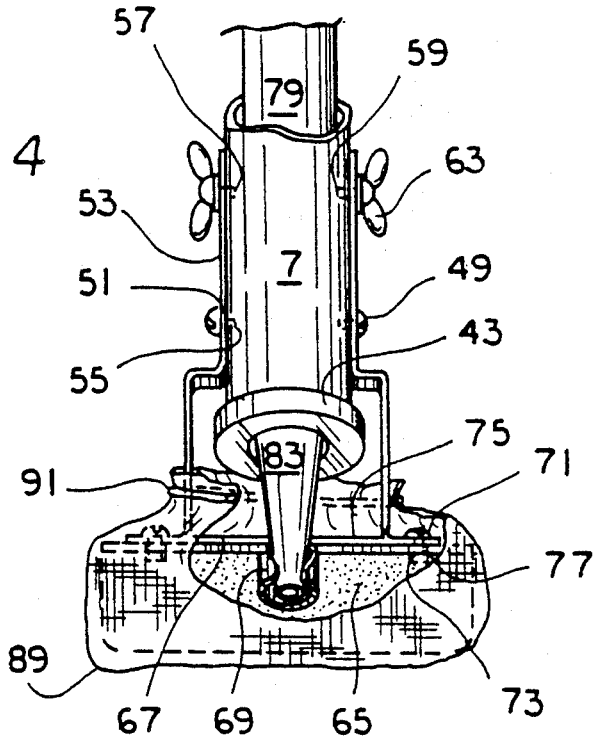
FIG. 4 is a front elevational view, partly broken away, of a distal portion of the invention.
Figure 5:
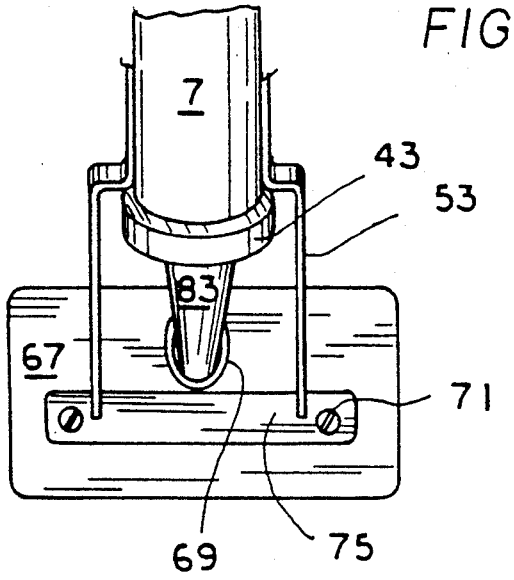
FIG. 5 is a top view of a distal portion of the invention.

Then the wing nuts 63 are appropriately engaged with their threaded studs 57 and tightened. A perforated cloth 89, having elastic 91 at its top, is positioned upon the spreader 65 to cover the spreader 65, as shown in FIG. 4. The plunger 5 is incrementally driven, as hereinbefore described, so that its piston 9 will operatively engage the circular plug 81 of the cartridge tube 79 to force paste wax through the nozzle 81 and into the spreader 65. The perforated cloth 89 allows the dispensed paste wax to be applied in a thin and even coat to the floor surface being waxed. The paste wax is applied by contact of the flat bottom of the spreader 65 with the floor surface, and with the relative angle of the housing 7 and spreader 65 maintained, as shown in FIG. 2. The applicator has sufficient length to allow the human operator to remain in a non-fatiguing upright position, with one hand holding the handle and the other hand cradling the mid portion of the housing 3, while applying the paste wax. With the cartridge-gun mechanism 15, the human operator can maintain continuous discrete control, at all times, over the amount of paste wax being dispensed and applied upon the floor surface being waxed.

I claim:

1. A paste wax applicator having an elongated cylindrical housing proximally carrying a handle, said elongated cylindrical housing being of sufficient length to allow a human operator employing the applicator to remain in a non-fatiguing upright position while applying, to a floor surface via the applicator's spreader, paste wax dispensed from a cartridge tube into the spreader, and concomitantly allowing the human operator to hold the handle with one hand and allowing the human operator to hold with his other hand, in cradling relationship, the elongated cylindrical housing; said paste wax applicator comprising the elongated cylindrical housing, a plunger, a cylindrical cartridge-tube housing, a piston, an intermediate cap, an end cap, a cartridge-gun mechanism means, a handle, a cartridge tube, an interiorly threaded end cap and a spreader; said elongated cylindrical housing receiving therein said plunger, said cylindrical cartridge-tube housing receiving therein said piston, said plunger having a proximal end and a distal end, said elongated cylindrical housing having a proximal end and a distal end, said cylindrical cartridge-tube housing having a proximal end portion, said intermediate cap being intermediate with and fixed to said distal end of said elongated cylindrical housing and said proximal end of said cylindrical cartridge-tube housing, said end cap being fixed to said proximal end of said elongated cylindrical housing, said intermediate cap and said end cap having aligned center holes, said center holes of said intermediate cap and said end cap freely receiving and centrally disposing said plunger within said elongated cylindrical housing, said handle being fixed to and extending proximally from said end cap, said handle having a proximal end portion, said cartridge-gun mechanism means being mounted on said proximal end portion of said handle, said cylindrical cartridge-tube housing receiving therein said cartridge tube, said cartridge tube having its interior filled with paste wax, said cartridge tube having a proximal end and a distal end, said cartridge tube having a circular plug sealing its said proximal end, said cartridge tube having a nozzle at its said distal end, said nozzle of said cartridge tube having a proximal portion in communication with said interior of said cartridge tube, said cylindrical cartridge-tube housing having an exteriorly threaded distal end, said interiorly threaded end cap being threadingly engaged with said threaded distal end of said cylindrical cartridge-tube housing, said interiorly threaded end cap having a central opening, said nozzle of said cartridge tube having a distal portion, said distal portion of said nozzle of said cartridge tube being disposed through and projecting distally through said central opening of said interiorly threaded end cap, said spreader having side arms, said cylindrical cartridge-tube housing carrying said side arms of said spreader and disposing said spreader below said interiorly threaded end cap, said spreader receiving interiorly therein said distal portion of said nozzle, said cartridge-gun mechanism means being manipulatively operable for incrementally and rectilinearly advancing said plunger distally for said piston to engage and distally move said circular plug of said cartridge tube to force paste wax through said nozzle and interiorly within said spreader, thereby allowing discrete amounts of the paste wax to be controllingly dispensed for application upon the floor surface.

2. A paste wax applicator in accordance with claim 1, wherein said spreader has a nozzle-bearing sleeve projecting interiorly within said spreader and said nozzle-bearing sleeve receives said distal portion of said nozzle.

3. A paste wax applicator in accordance with claim 1, wherein said spreader has a flat bottom surface.

4. A paste wax applicator in accordance with claim 1, wherein said spreader is made of fabricated material.

5. A paste wax applicator in accordance with claim 1, wherein is further provided a perforated cloth, wherein said perforated cloth covers said spreader to allow dispensed paste wax to be applied in thin and even coats upon the floor surface.

6. A paste wax applicator in accordance with claim 1, wherein said spreader has a nozzle-bearing sleeve projecting interiorly within said spreader and said nozzle-bearing sleeve receives said distal portion of said nozzle, wherein said spreader has a flat bottom surface, wherein said spreader is made of fabricated material, and wherein is further provided a perforated cloth, wherein said perforated cloth covers said spreader to allow dispensed paste wax to be applied in thin and even coats upon the floor surface.

* * * * *